US009525199B2

(12) United States Patent
Kawamura et al.

(10) Patent No.: US 9,525,199 B2
(45) Date of Patent: Dec. 20, 2016

(54) MILLIMETER WAVEBAND FILTER

(71) Applicant: ANRITSU CORPORATION, Atsugi-shi, Kanagawa (JP)

(72) Inventors: Takashi Kawamura, Kanagawa (JP); Hiroshi Shimotahira, Kanagawa (JP)

(73) Assignee: ANRITUS CORPORATION, Atsugi-Shi (JP)

( * ) Notice: Subject to any disclaimer, the term of this patent is extended or adjusted under 35 U.S.C. 154(b) by 46 days.

(21) Appl. No.: 14/623,015

(22) Filed: Feb. 16, 2015

(65) Prior Publication Data

US 2015/0263399 A1 Sep. 17, 2015

(30) Foreign Application Priority Data

Mar. 14, 2014 (JP) ..... 2014-051102

(51) Int. Cl.
*H01P 1/207* (2006.01)
*H01P 1/208* (2006.01)
*H01P 5/02* (2006.01)

(52) U.S. Cl.
CPC ..... *H01P 1/208* (2013.01); *H01P 5/024* (2013.01)

(58) Field of Classification Search
CPC ..... H01P 1/208; H01P 5/024
USPC ..... 333/209
See application file for complete search history.

(56) References Cited

U.S. PATENT DOCUMENTS 4,283,727 A * 8/1981 Martel ..... H01P 1/061 333/257
8,917,149 B2 * 12/2014 Blech ..... H01P 1/165 333/21 A
2013/0135063 A1 * 5/2013 Kawamura ..... H01P 7/06 333/209

FOREIGN PATENT DOCUMENTS

JP 2013-138401 A 7/2013

* cited by examiner

*Primary Examiner* — Stephen E Jones
*Assistant Examiner* — Scott S Outten
(74) *Attorney, Agent, or Firm* — Pearne & Gordon LLP

(57) ABSTRACT

In a millimeter waveband filter, electric wave half mirrors are provided in transmission lines of a first waveguide configured to allow electromagnetic waves in a predetermined frequency range of a millimeter waveband to propagate in a TE10 mode and a second waveguide connected to the first waveguide in a state where one end of the second waveguide is inserted into the first waveguide, and the waveguides are relatively moved to vary the interval between the electric wave half mirrors, thereby changing a resonance frequency. The first waveguide is a square waveguide, and the second waveguide is a ridge waveguide in which the outside thereof is a rectangular shape at a predetermined interval with respect to the inside of the first waveguide and a sectional shape of a transmission line has a central portion having a height smaller than both side portions.

20 Claims, 10 Drawing Sheets

MILLIMETER WAVEBAND FILTER

TECHNICAL FIELD

The present invention relates to a filter which is used in a millimeter waveband.

BACKGROUND ART

In recent years, there is an increasing need for the use of electric waves in response to a ubiquitous network society, and a wireless personal area network (WPAN) which realizes wireless broadband at home or a millimeter waveband wireless system, such as a millimeter-wave radar, which supports safe and secure driving starts to be used. An effort to realize a wireless system at a frequency equal to or greater than 100 GHz is actively made.

In regard to second harmonic evaluation of a wireless system in a 60 to 70 GHz band or evaluation of a radio signal in a frequency band equal to or greater than 100 GHz, as the frequency becomes high, the noise level of a measurement device and conversion loss of a mixer increase and frequency precision is lowered. For this reason, a high-sensitivity and high-precision measurement technology of a radio signal over 100 GHz has not been established. In the conventional measurement technology, it is not possible to separate harmonics of local oscillation from the measurement result, and there is difficulty in strict measurement of unnecessary emission or the like.

In order to overcome the problems in the related art and to realize high-sensitivity and high-precision measurement of a radio signal in a frequency band equal to or greater than 100 GHz, it is necessary to develop a narrowband filter technology of a millimeter waveband for the purpose of suppressing an image response and a high-order harmonic response, and in particular, there is a demand for a technology which is adaptable to a variable frequency type (tunable).

In order to realize this, the applicant has suggested a millimeter waveband filter in which a Fabry-Perot resonator used in an optical field is applied to millimeter waves and desired frequency components of the millimeter waves are selectively transmitted by a resonance action between a pair of electric wave half mirrors arranged to face each other inside a transmission line allowing propagation in a TE10 mode (single mode) (Patent Document 1).

RELATED ART DOCUMENT

Patent Document

[Patent Document 1] JP-A-2013-138401

SUMMARY OF THE INVENTION

Problem that the Invention is to Solve

Patent Document 1 described above discloses a structure in which a transmission line allowing electromagnetic waves in a desired frequency band to propagate in a TE10 mode is constituted by a first waveguide having a rectangular sectional shape and a second waveguide having a rectangular sectional shape with one end thereof inserted into the first waveguide at a slight interval, electric wave half mirrors are provided inside the first waveguide and at the leading end of the second waveguide, and the other waveguide is relatively moved in a longitudinal direction with respect to one waveguide to change the gap.

In this structure, the size of the second waveguide inserted into the first waveguide is inevitably smaller than the size of the first waveguide by the thickness of the second waveguide and the interval between the waveguides necessary for movement and a propagatable frequency range in the TE10 mode is different according to the size difference. Accordingly, when the waveguides having a rectangular sectional shape described above are used, it is a prerequisite that the waveguides are used in a region where the propagatable frequency ranges in the TE10 mode determined by the sizes of both waveguides overlap each other.

For example, even when a generally known WR-10 waveguide having a size of 2.54×1.27 mm is used as the outer first waveguide, the required minimum thickness of the second waveguide is about 0.1 mm, and the interval between both waveguides is 30 μm, the size (the sectional shape of the inside) of the second waveguide becomes 2.28×1.01 mm, a lower limit frequency of a propagatable frequency domain in the TE10 mode increases by a decrease in size, and a low frequency band is narrowed.

For example, in order to realize a wide band, while the thickness of the second waveguide is required to be as small as possible, actually, there is a limit in decreasing the thickness for strength or ease of manufacturing.

A frequency at which a different mode (LSE11 mode) is excited due to the size difference of the transmission line described above is present in a usage band, leading to an increase in insertion loss.

As one method of solving this, while a method which increases the thickness of the second waveguide and moves the frequency, at which the different mode (LSE11 mode) is generated, to a region lower than the lower limit of the usage band is considered, if the thickness of the second waveguide further increases, a frequency at which a subsequent mode is generated in a high frequency band is lowered and falls in the usage band, making it difficult to realize a wider band.

The invention has been accomplished to solve the above-described problem newly caused by a wide band including a low frequency band, and an object of the invention is to provide a millimeter waveband filter which can vary a resonance frequency in a wider band.

Means for Solving the Problem

In order to attain the above-described object, a first aspect of the invention provides a millimeter waveband filter including a first waveguide, a second waveguide, the second waveguide being connected to the first waveguide in a state where one end of the second waveguide is inserted into the first waveguide to constitute a transmission line allowing electromagnetic waves in a predetermined frequency range of a millimeter waveband to propagate in a TE10 mode, a pair of flat electric wave half mirrors which have characteristics to transmit a part of the electromagnetic waves in the predetermined frequency range and to reflect a part of the electromagnetic waves and are arranged to face each other at an interval in a state where the first waveguide and the second waveguide are blocked, and interval variable means for relatively moving the first waveguide and the second waveguide in a longitudinal direction of the transmission line in a state connected together to change the interval between the pair of electric wave half mirrors. Frequency components centering on a resonance frequency of a resonator formed between the pair of electric wave half mirrors are selectively transmitted, the first waveguide is a square waveguide in which the sectional shape of the inside of the first waveguide is a rectangular shape such that a lower limit frequency of a propagatable frequency band of the first waveguide in the TE10 mode is equal to or less than a lower limit of the predetermined frequency range, the second waveguide is a ridge waveguide in which the outside thereof is a rectangular shape at a predetermined interval with respect to the inside of the first waveguide and the sectional shape of the inside thereof has a central portion having a height smaller than the height of both side portions, and the height and width of each of both side portions and the central portion are set such that a lower limit frequency of a propagatable frequency band of the second waveguide in the TE10 mode is equal to or less than the lower limit frequency of the propagatable frequency band of the first waveguide in the TE10 mode.

According to a second aspect of the invention, in the millimeter waveband filter according to the first aspect of the invention, a groove which has a length along the longitudinal direction of the transmission line corresponding to a ¼ wavelength of electromagnetic waves to be a leakage prevention target is formed on the outside of the second waveguide facing the inside of the first waveguide, and leakage of the electromagnetic waves from the interval between the outside of the second waveguide and the inside of the first waveguide is prevented by the groove.

According to a third aspect of the invention, in the millimeter waveband filter according to the first aspect of the invention, the pair of electric wave half mirrors respectively have rectangular plates which have a predetermined thickness and reflect electromagnetic waves propagating through the transmission line, and slits which are formed in central portions of the plates along a long side direction of the plates and transmit a part of the electromagnetic waves propagating through the transmission line, and the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range.

According to a fourth aspect of the invention, in the millimeter waveband filter according to a second aspect of the invention, the pair of electric wave half mirrors respectively have rectangular plates which have a predetermined thickness and reflect electromagnetic waves propagating through the transmission line, and slits which are formed in central portions of the plates along a long side direction of the plates and transmit a part of the electromagnetic waves propagating through the transmission line, and the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range.

According to a fifth aspect of the invention, in the millimeter waveband filter according to the first aspect of the invention, the sectional shape of the inside of the second waveguide is linearly symmetrical with a center line in a height direction and a center line in a width direction of the rectangular shape of the outside of the second waveguide.

According to a sixth aspect of the invention, in the millimeter waveband filter according to the second aspect of the invention, the sectional shape of the inside of the second waveguide is linearly symmetrical with a center line in a height direction and a center line in a width direction of the rectangular shape of the outside of the second waveguide.

According to a seventh aspect of the invention, in the millimeter waveband filter according to the third aspect of the invention, the sectional shape of the inside of the second waveguide is linearly symmetrical with a center line in a height direction and a center line in a width direction of the rectangular shape of the outside of the second waveguide.

According to an eighth aspect of the invention, in the millimeter waveband filter according to the fourth aspect of the invention, the sectional shape of the inside of the second waveguide is linearly symmetrical with a center line in a height direction and a center line in a width direction of the rectangular shape of the outside of the second waveguide.

According to a ninth aspect of the invention, in the millimeter waveband filter according to the second aspect of the invention, the groove is provided in a plurality of stages with respect to a length direction of the transmission line.

According to a tenth aspect of the invention, in the millimeter waveband filter according to the fourth aspect of the invention, the groove is provided in a plurality of stages with respect to a length direction of the transmission line.

According to an eleventh aspect of the invention, in the millimeter waveband filter according to the sixth aspect of the invention, the groove is provided in a plurality of stages with respect to a length direction of the transmission line.

According to a twelfth aspect of the invention, in the millimeter waveband filter according to the eighth aspect of the invention, the groove is provided in a plurality of stages with respect to a length direction of the transmission line.

Advantage of the Invention

In this way, the millimeter waveband filter of the invention includes the first waveguide, the second waveguide, the second waveguide being connected to the first waveguide in a state where one end of the second waveguide is inserted into the first waveguide to constitute the transmission line allowing electromagnetic waves in the predetermined frequency range of the millimeter waveband to propagate in the TE10 mode, the pair of flat electric wave half mirrors which have characteristics to transmit a part of the electromagnetic waves in the predetermined frequency range and to reflect a part of the electromagnetic waves and are arranged to face each other at the interval in a state where the first waveguide and the second waveguide are blocked, and the interval variable means for relatively moving the first waveguide and the second waveguide in the longitudinal direction of the transmission line in a state connected together to change the interval between the pair of electric wave half mirrors. The frequency components centering on the resonance frequency of the resonator formed between the pair of electric wave half mirrors are selectively transmitted, the first waveguide is a square waveguide in which the sectional shape of the inside of the first waveguide is a rectangular shape such that the lower limit frequency of the propagatable frequency band of the first waveguide in the TE10 mode is equal to or less than the lower limit of the predetermined frequency range, the second waveguide is a ridge waveguide in which the outside thereof is a rectangular shape at a predetermined interval with respect to the inside of the first waveguide and the sectional shape of the inside thereof has a central portion having a height smaller than the height of both side portions, and the height and width of each of both side portions and the central portion are set such that the lower limit frequency of the propagatable frequency band of the second waveguide in the TE10 mode is equal to or less than the lower limit frequency of the propagatable frequency band of the first waveguide in the TE10 mode.

Like the ridge waveguide, a waveguide, in which the height of the central portion (the sectional shape of the inside) of the transmission line is set to be smaller than the height of both side portions, has a characteristic that, even if the area of the transmission line is smaller than a standard square waveguide, electromagnetic waves in a low frequency domain can propagate in the TE10 mode.

Accordingly, even when the second waveguide has the outside so as to be inserted into the first waveguide at a narrow interval and has a comparatively large thickness, the height and width of each of the central portion and both side portions of the transmission line are selected, whereby it is possible to make the lower limit frequency of the propagatable frequency band of the second waveguide smaller than the lower limit frequency of the propagatable frequency band of the square first waveguide, and there is no limit on a low frequency band of a usage frequency range caused by the size difference between the two waveguides, thereby realizing a wide band.

It is possible to move the frequency generated by the different mode (LSE11 mode) to a high frequency band, to prevent an increase in insertion loss in the usage frequency range by the movement of the frequency to the high frequency band, and to realize a wide band including a low frequency band.

In the millimeter waveband filter according to the second aspect of the invention, the groove which has the length along the longitudinal direction of the transmission line corresponding to the ¼ wavelength of the electromagnetic waves to be a leakage prevention target is formed on the outside of the second waveguide to prevent leakage of the electromagnetic waves from the interval between the waveguides. For this reason, it is not necessary to make the thickness of the second waveguide greater than the ¼ wavelength of the electromagnetic waves to be a leakage prevention target, and there is no limit in setting the dimension of the transmission line of the second waveguide.

In the millimeter waveband filter according to the third aspect of the invention, the slits which are provided on the plates of the electric wave half mirrors are of a ridge type in which the height of the central portion is set to be smaller than the height of both side portions. For this reason, many parameters including the thickness of the plates and the width and height of each of both side portions and the central portion of the slits are selected, whereby it is possible to set the parameters such that transmittance to the electromagnetic waves propagating through the transmission line becomes flat in the predetermined frequency range, and to realize a wider band as a filter.

MODE FOR CARRYING OUT THE INVENTION

Figure 1A:
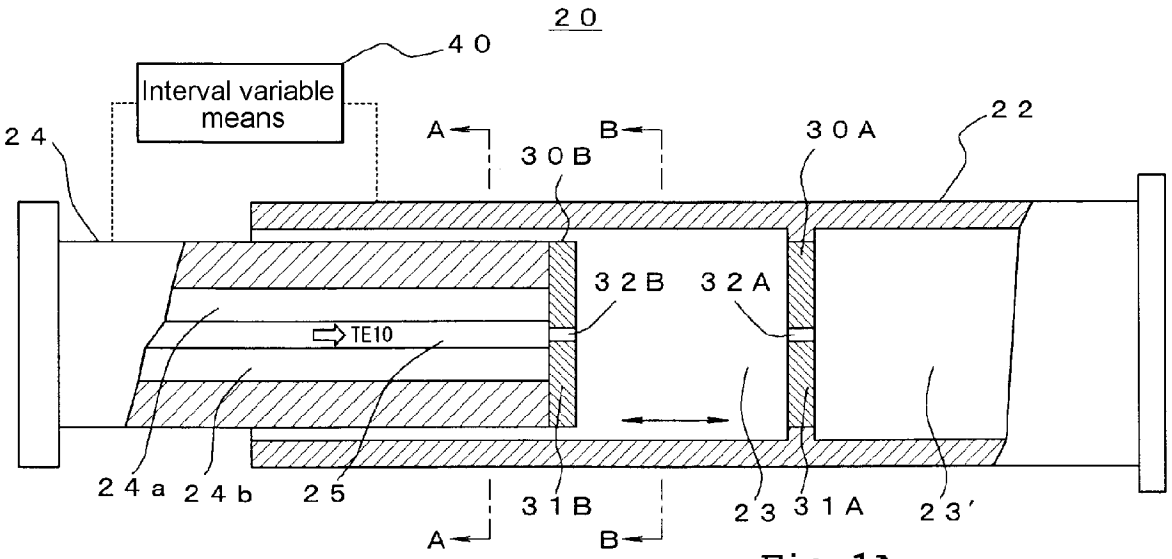
FIGS. 1A to 1C are basic structure diagrams of a millimeter waveband filter of the invention.

Hereinafter, an embodiment of the invention will be described referring to the drawings.

Figure 1C:
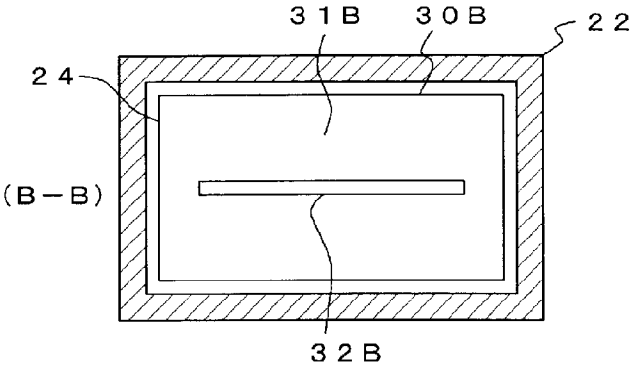
Figure 1B:
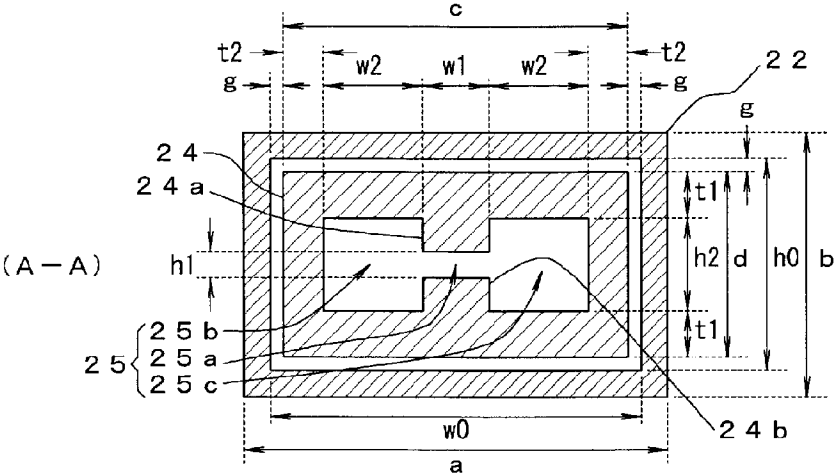

FIGS. 1A to 1C show the basic structure of a millimeter waveband filter 20 of the invention. FIG. 1A is a diagram when a part of the millimeter waveband filter 20 is fractured from the side, FIG. 1B is a sectional view taken along the line A-A of FIG. 1A, and FIG. 1C is a sectional view taken along the line B-B of FIG. 1A.

As shown in FIGS. 1A to 1C, the millimeter waveband filter 20 has a first waveguide 22, a second waveguide 24, a pair of electric wave half mirrors 30A and 30B, and interval variable means 40.

The first waveguide 22 is a square waveguide which has a transmission line 23 (the inside of the first waveguide) having a rectangular sectional shape allowing electromagnetic waves in a predetermined frequency range (for example, 75 to 110 GHz) of a millimeter waveband to propagate in a TE10 mode (single mode). For example, a WR-10 waveguide having a size of w0×h0=2.54×1.27 mm can be used. In FIGS. 1A to 1C, a left transmission line 23 and a right transmission line 23' are separated by the electric wave half mirror 30A. In the basic structure, while the two transmission lines 23 and 23' have the same size, the right transmission line 23' connected to an external circuit may have a standard size corresponding to the WR-10 type, and the size of the left transmission line 23, into which the second waveguide 24 is inserted, may be slightly greater than the standard size (for example, w0'×h0'=2.65×1.47 mm).

Figure 2:
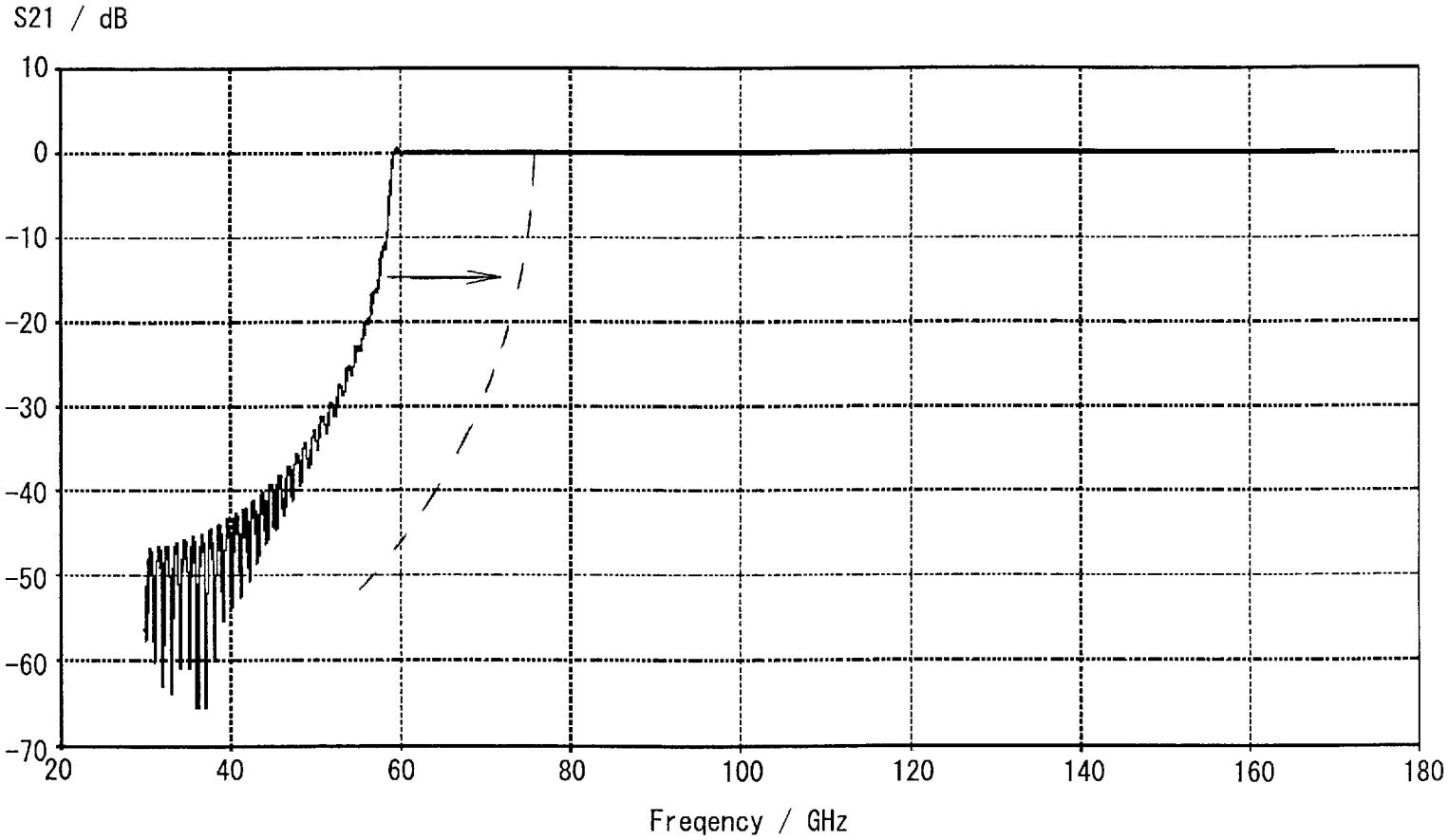
FIG. 2 is a transmission characteristic diagram of a general square waveguide.

FIG. 2 shows a transmission characteristic (S21) of a WR-10 waveguide having a size of w0×h0=2.54×1.27 mm which can be used as the first waveguide 22, and shows a characteristic which has low loss and is flat in a range from a lower limit frequency of 60 GHz to 160 GHz.

The second waveguide 24 has a transmission line which allows the electromagnetic waves in the predetermined frequency range (for example, 75 to 110 GHz) to propagate in the TE10 mode like the first waveguide 22, and is connected to the first waveguide 22 in a state where at least one end thereof is inserted into the first waveguide 22.

As described above, if a square waveguide in which a sectional shape of a transmission line is a rectangular shape is used as the second waveguide 24, the transmission line is thinned by the sum of an interval necessary for a relative movement of the waveguide and the thickness of the waveguide. Then, as indicated by a dotted line of FIG. 2, a cutoff frequency of a low frequency band is moved to a high frequency band and a usable range is narrowed.

Accordingly, in the millimeter waveband filter 20, protrusions 24*a* and 24*b* which protrude in a direction approaching each other from the centers of the insides on the upper and lower sides (the long sides of the outside) of the second waveguide 24 are continuously formed, and the sectional shape of the transmission line 25 (the inside of the second waveguide) substantially has a H shape. In this way, a waveguide in which the height h1 of a central portion 25*a* of the transmission line 25 is set to be smaller than the height h2 of both side portions 25*b* and 25*c* is generally referred to as a ridge waveguide.

In case of the ridge waveguide, the width w1 and height h1 of the central portion 25*a* and the width w2 and height h2 of both side portions 25*b* and 25*c* are selected, whereby it is possible to allow the electromagnetic waves in the equivalent frequency range to propagate in the TE10 mode with the sectional shape smaller than the sectional shape of the transmission line of the standard square waveguide.

Figure 3:
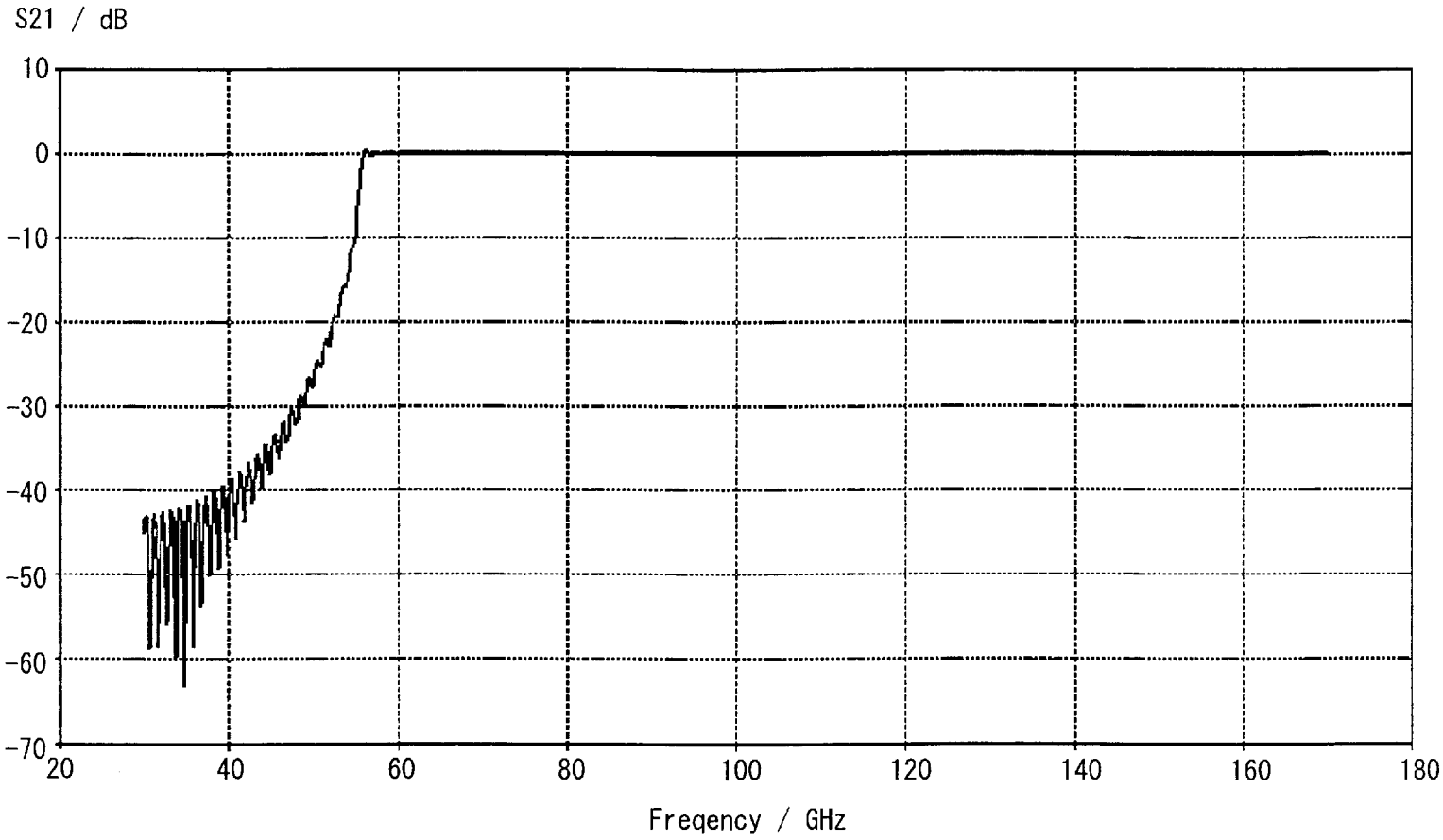
FIG. 3 is a transmission characteristic diagram of a ridge waveguide having a size smaller than the waveguide of FIG. 2.

As a dimension example of the second waveguide 24 of this embodiment, as shown in FIG. 1B, the interval g with respect to the inside of the first waveguide 22 is set to 30 μm, the size of the rectangular shape is c×d=2.59×1.14 mm, the width and height of the central portion 25*a* of the transmission line are w1=0.5 mm and h1=0.27 mm, the width and height of the side portions 25*b* and 25*c* of the transmission line are w2=0.72 mm and h2=0.67 mm, the thickness of the upper and lower sides (the long sides) t1=0.37 mm, the thickness of the right and left sides (the short sides) is t2=0.325 mm, and the transmission characteristic (S21) of the waveguide having this shape is as shown in FIG. 3. In FIGS. 1A to 1C, the outside a×b of the first waveguide 22 is greater than the size w0×h0 and is arbitrary in a range where strength as a structure is obtained.

As will be apparent from FIG. 3, even though the sectional shape of the second waveguide 24 is significantly smaller than the sectional shape of the transmission line of the standard WR-10 waveguide shown in FIG. 2, the lower limit frequency is lowered to about 56 GHz.

Accordingly, even if the ridge waveguide is used as the second waveguide 24, it is possible to allow electromagnetic waves in a predetermined frequency range (75 to 110 GHz) for use, and to propagate in the TE10 mode with low loss.

In this way, the two waveguides 22 and 24 having different sizes are connected and a ridge waveguide is used as the inner waveguide, whereby transmission lines allowing electromagnetic waves in a desired frequency range to propagate in the TE10 mode are continuously formed.

Although an example where the lower limit frequency of the propagatable frequency band of the second waveguide 24 becomes lower than the lower limit frequency (in the example of FIG. 2, 60 GHz) of the propagatable frequency band of the first waveguide 22 has been described, the lower limit frequency of the propagatable frequency band of the second waveguide may be set to be equal to or less than the lower limit frequency of the propagatable frequency band of the first waveguide. In this way, the shape of the transmission line of the second waveguide 24 is set, whereby there is no limit on the frequency band by the size difference between the two waveguides and it is possible to realize a wide band even if the second waveguide 24 having a large thickness is used.

A pair of flat electric wave half mirrors 30A and 30B have a characteristic to transmit a part of electromagnetic waves in a predetermined frequency range and to reflect a part of the electromagnetic waves, and are provided to face each other at a gap in a state where the transmission line 23 of the first waveguide 22 and the transmission line 25 of the second waveguide 24 are blocked (also can be read as a state where the first waveguide and the second waveguide are blocked).

Specifically, each of the electric wave half mirrors 30A and 30B has a rectangular outside which blocks the transmission line of the waveguide. One electric wave half mirror 30A is fixed in the transmission line of the first waveguide 22, and the other electric wave half mirror 30B is provided at the leading end (the right end in FIGS. 1A to 1C) of the second waveguide 24.

The electric wave half mirrors 30A and 30B have rectangular plates 31A and 31B which have a predetermined thickness and are made of a metal material to reflect electromagnetic waves propagating through the transmission lines, and slits 32A and 32B which are formed in the central portions of the plates 31A and 31B in the long side direction of the plates 31A and 31B and transmit a part of the electromagnetic waves propagating through the transmission lines.

In regards to the slits 32A and 32B, in FIG. 1C which shows the basic structure of the filter, although a simple structure in which the height is constant over the width direction has been shown, as described below, the height of a portion may be different from other portions.

The interval variable means 40 relatively moves the first waveguide 22 and the second waveguide 24 in the long side direction of the transmission lines in a state connected together to vary the gap between a pair of electric wave half mirrors 30A and 30B, thereby varying the resonance frequency of the filter determined by the gap. Although the specific structure of the interval variable means 40 is arbitrary, specifically, the first waveguide 22 having a large size may be fixed and supported, and the second waveguide 24 may be moved in the longitudinal direction in a state concentric with the first waveguide 22. As a drive method, a configuration in which the rotation power of a motor is converted to linear motion to advance or retreat the second waveguide 24 with respect to the first waveguide 22, or the like can be used.

In the above-described millimeter waveband filter 20, although the basic structure in which the ridge waveguide is used as the second waveguide 24 has been shown, since the second waveguide 24 can have a large thickness due to a small sectional shape of the transmission line, it is considered that a groove (choke) for electromagnetic wave leakage prevention is formed.

Although Patent Document 1 described above describes that the groove for electromagnetic wave leakage prevention is provided at a predetermined depth from the inside toward the outside of the outer waveguide to prevent leakage of electromagnetic waves having a wavelength corresponding to the depth, in this way, when the groove is provided on the inside of the outer waveguide, if the inner waveguide is moved with respect to the outer waveguide so as to change the resonance wavelength, it is confirmed that the distance from the outer circumference of the leading end of the inner waveguide to the groove changes, and the frequency of unnecessary resonance determined by the distance changes, adversely affecting the passing characteristic of the filter.

In order to solve this, it is considered that a groove for electromagnetic wave leakage prevention is provided on the outer circumference of the inner waveguide to prevent change in distance to the groove with the movement of the waveguides.

However, the required length as the groove for electromagnetic wave leakage prevention is around 1 mm which is substantially ¼ of a guide wavelength (center wavelength) to be prevented. For this reason, for example, even if the above-described ridge waveguide is used as the second waveguide 24, it is not possible to form the groove at a depth of about 1 mm from the outside toward the inside (in the above-described numerical example, the thickness t1 of 0.37 mm protrudes).

As a method of solving this, it has been examined whether or not it is possible to match the length direction representing the electromagnetic wave leakage prevention action of the groove with the length direction of the transmission line.

Figure 4A:
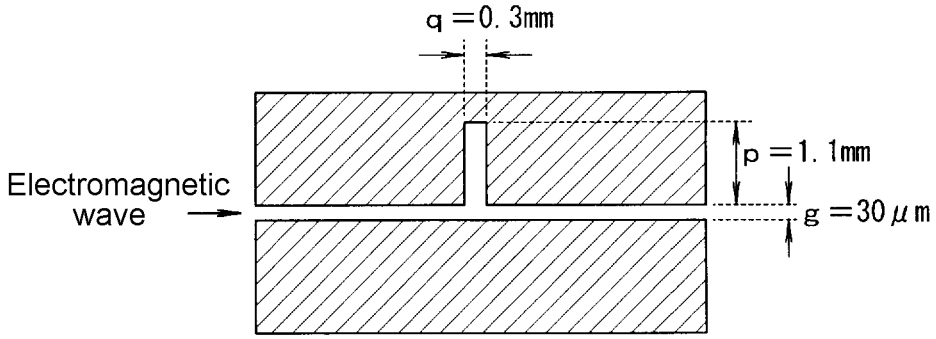
FIGS. 4A and 4B are model diagrams when a length direction of a groove for electromagnetic wave leakage prevention is changed with respect to an interval.
Figure 4B:
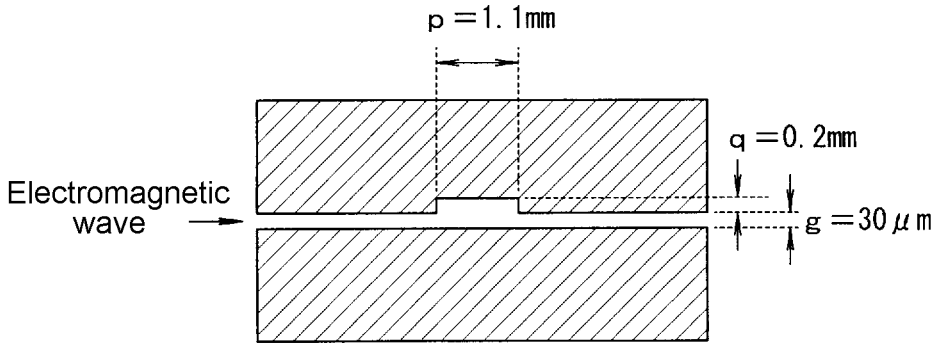
Figure 5:
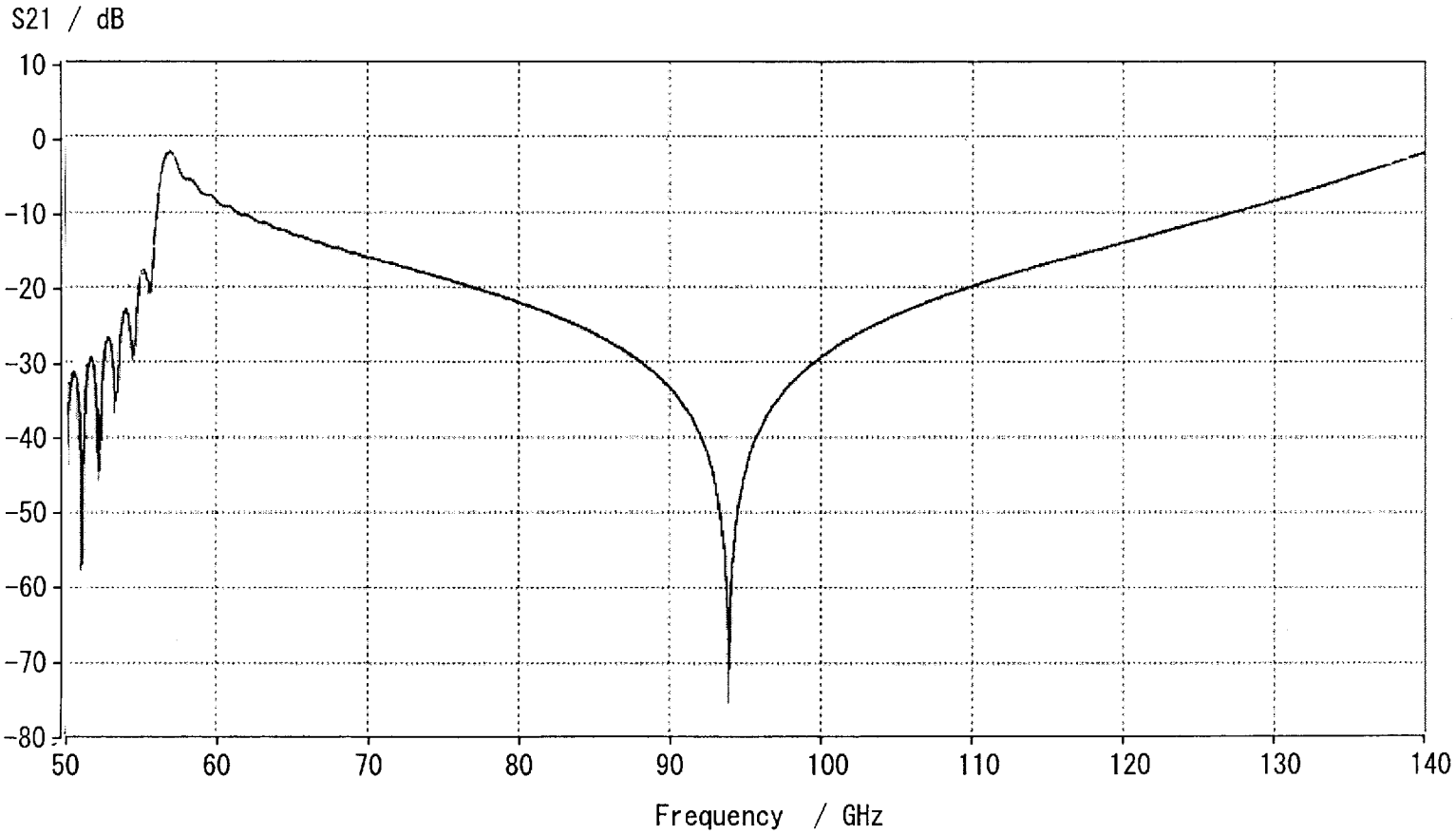
FIG. 5 shows a simulation result of a model in which a propagation direction of electromagnetic waves propagating through an interval is orthogonal to a length direction of a groove for electromagnetic wave leakage prevention.
Figure 6:
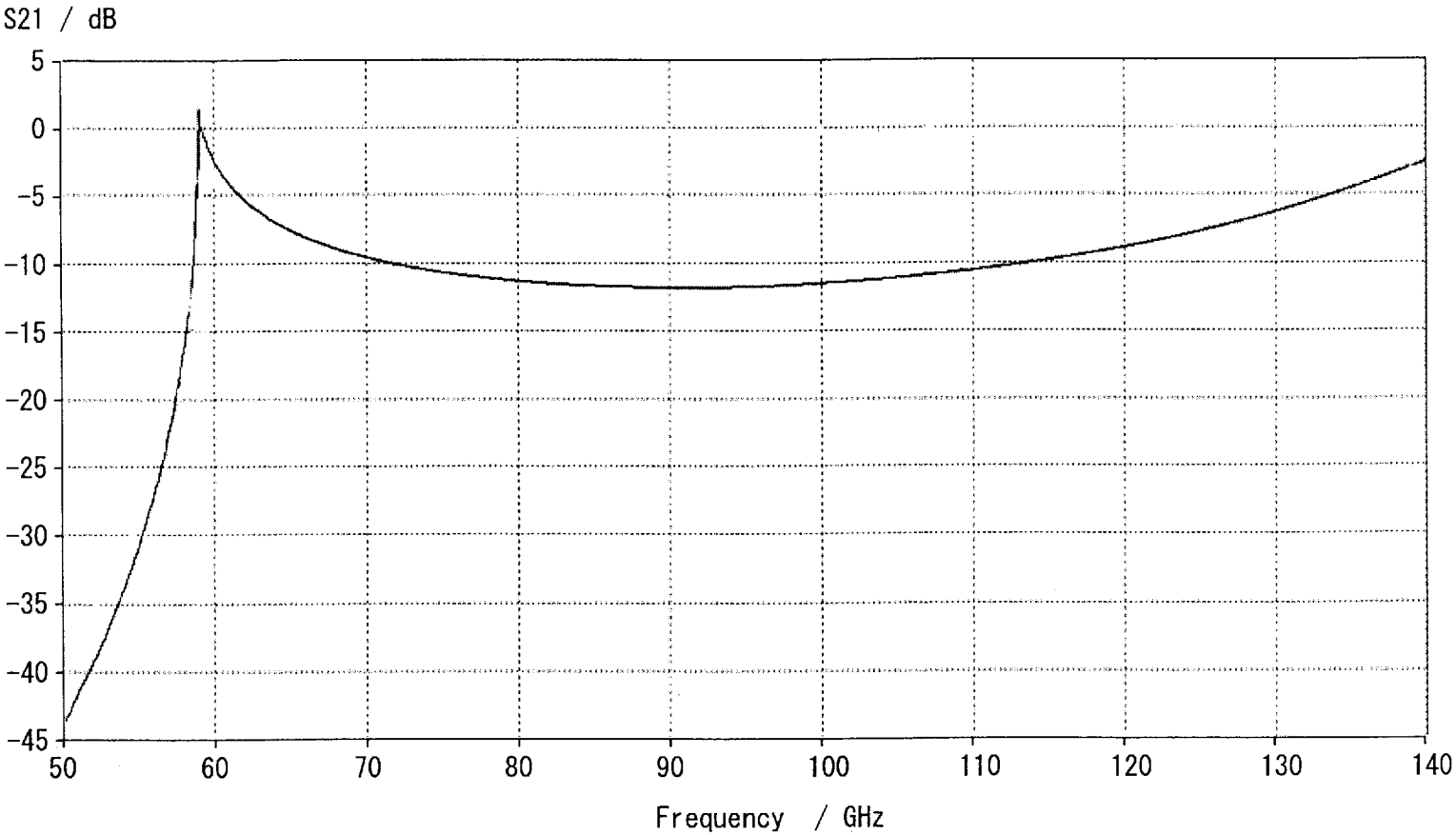
FIG. 6 shows a simulation result of a model in which a propagation direction of electromagnetic waves propagating through an interval is parallel to a length direction of a groove for electromagnetic wave leakage prevention.

FIG. 4A shows a related art model in which a groove having a length of 1.1 mm and a width of 0.3 mm is provided so as to be orthogonal to a gap of 30 μm (transmission line by the interval), and FIG. 4B shows an examination model in which a groove having a length of 1.1 mm and a depth of 0.2 mm is provided along a gap of 30 μm. The transmission characteristic of the related art model is obtained as shown in FIG. 5, and the transmission characteristic of the examination model is obtained as shown in FIG. 6.

In comparison of both in a range of 70 to 120 GHz, it is understood that the related art model obtains large attenuation compared to the examination model, and in particular, undergoes steep attenuation at 94 GHz. However, even in the examination model, attenuation of 10 dB is obtained in the above-described frequency range, and if the attenuation is not sufficient, it is possible to cope with this by forming a groove having the same shape in a plurality of stages along the length direction of the transmission line. From this result, it can be confirmed that the groove for electromagnetic wave leakage prevention can be formed so as to match the length direction representing the electromagnetic wave leakage prevention action with the length direction of the transmission line, and this technique can be sufficiently applied to the second waveguide 24 having a thickness of around 0.4 mm described above.

Figure 7A:
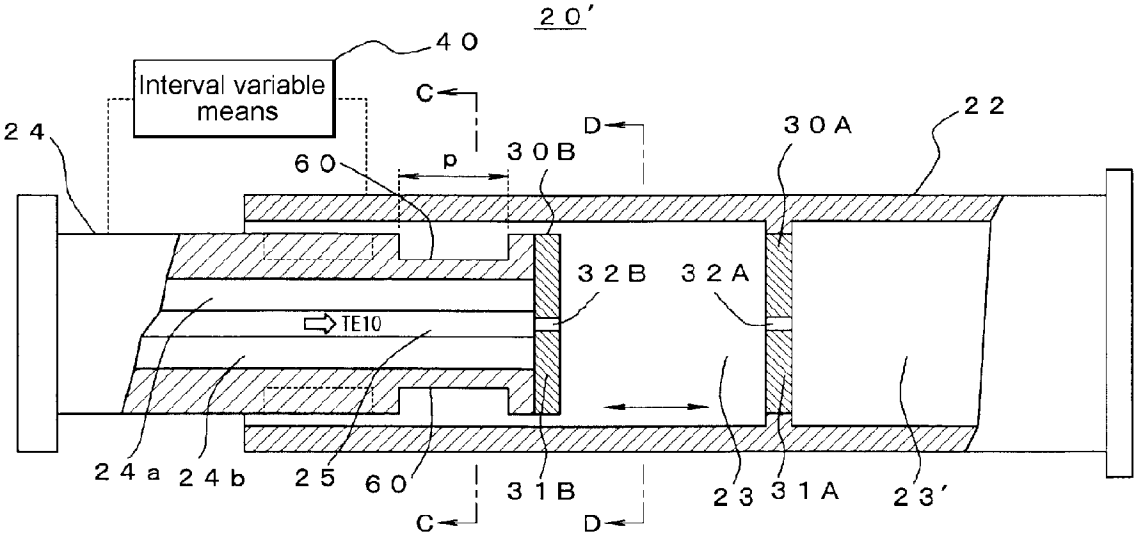
FIGS. 7A to 7C are specific structure diagrams of a millimeter waveband filter of the invention.
Figure 7C:
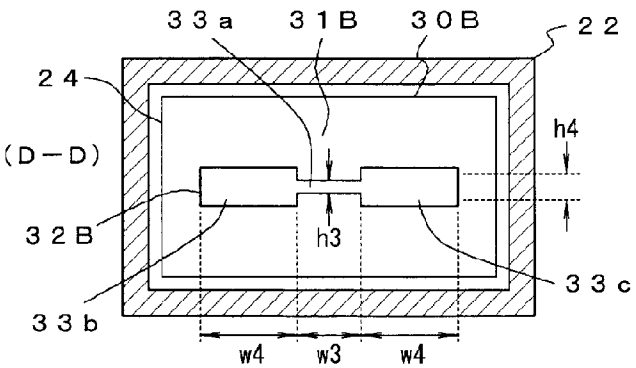
Figure 7B:
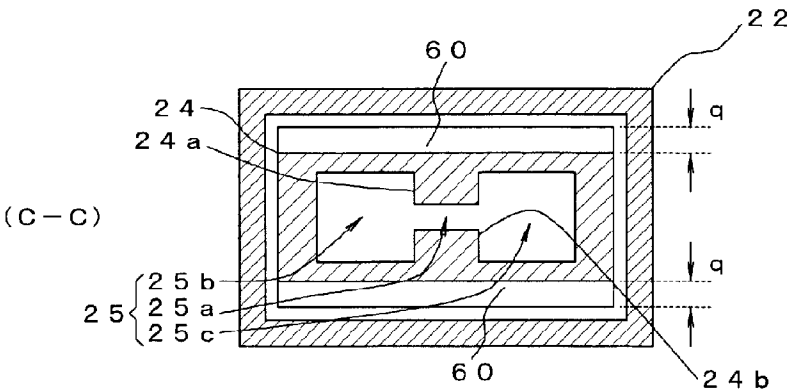

A millimeter waveband filter 20' shown in FIGS. 7A to 7C uses the examined technique described above, and grooves 60 for electromagnetic wave leakage prevention are provided on the upper and lower surfaces close to the leading end of the second waveguide 24 such that the direction representing the electromagnetic wave leakage prevention action becomes the length direction of the transmission line. That is, each groove 60 having a length of about p=1 mm representing the electromagnetic wave leakage prevention action is formed at a depth of about 0.2 mm. Even in this case, since the phase of electromagnetic waves propagating and returning from the edge of the groove 60 close to the half mirror to the edge away from the half mirror changes by λ/2 and input and output are cancelled (a choke effect in which impedance significantly increases with respect to leakage electromagnetic waves is exhibited), an electromagnetic wave leakage prevention effect is obtained.

While it is expected that the electromagnetic wave leakage prevention effect by the grooves 60 is attenuation of about 10 dB from the examination model, as indicated by a dotted line of FIG. 7A, a plurality of grooves 60 are arranged along the length direction of the transmission line (while two stages are shown in FIGS. 7A to 7C, the overlapping length of the waveguides may be extended and three or more stages may be provided), whereby it is possible to obtain a larger amount of attenuation.

Here, although the grooves 60 are provided on the outsides of the upper and lower sides (the long sides) of the second waveguide 24 having a high electromagnetic wave leakage prevention effect, grooves may be also provided on the outsides of the right and left sides (the short sides).

The grooves 60 should have a depth of about 0.2 mm so as to exhibit the electromagnetic wave leakage prevention effect (choke effect). For this reason, as in the related art, when a square waveguide is used as the second waveguide, as the thickness of the square waveguide, the dimension (0.3 mm) obtained by adding an amount corresponding to the depth (0.2 mm) of the grooves 60 and the required minimum thickness (0.1 mm) as a structure is required, and the low frequency band is narrowed by an increase in thickness.

As described above, as a result of various examinations on the reflection characteristic of the electric wave half mirrors 30A and 30B, it has been confirmed that, in the above-described slits having a shape with a constant height undergo, there is a movement to transmittance in a desired frequency range.

Figure 8:
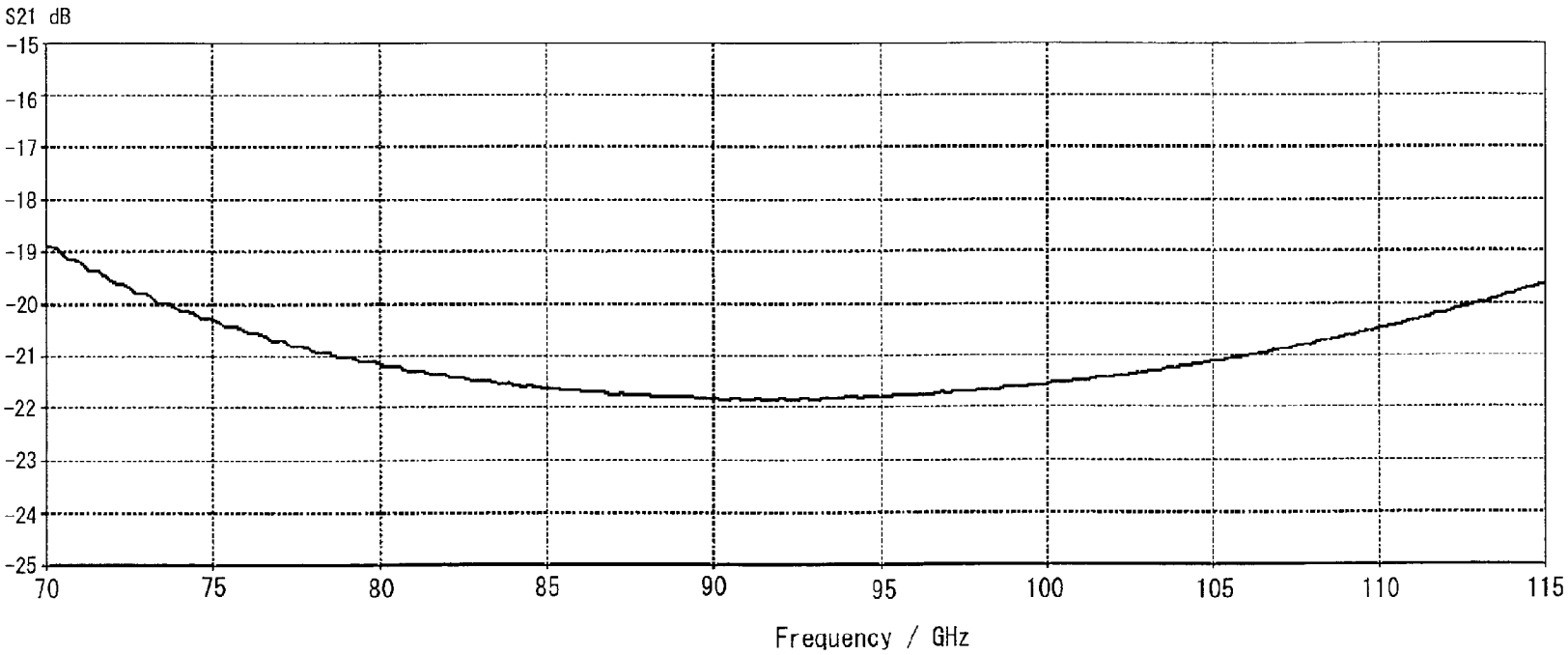
FIG. 8 is a transmission characteristic diagram of an electric wave half mirror in which a height of a slit is constant.

FIG. 8 shows a transmission characteristic of a single mirror when the slit 32A (32B) in the plate 31A (31B) having a thickness of 1 mm has a constant height of 50 μm (a transmission characteristic in a state where the electric wave half mirror is provided in the transmission line having the same outside as the plate), and shows a downward convex change in a range of 70 to 115 GHz.

In order to cope with this, in the millimeter waveband filter 20' shown in FIGS. 7A to 7C, as shown in FIG. 7C, as the slit 32B of the electric wave half mirror 30B, a ridge type is provided corresponding to the sectional shape of the transmission line 25 of the second waveguide 24 such that the height h3 of a central portion 33*a* having a width w3 is set to be smaller than the height h4 of side portions 33*b* and 33*c* having a width w4. Though not shown, the same slit shape applies to the other electric wave half mirror 30A.

Figure 9:
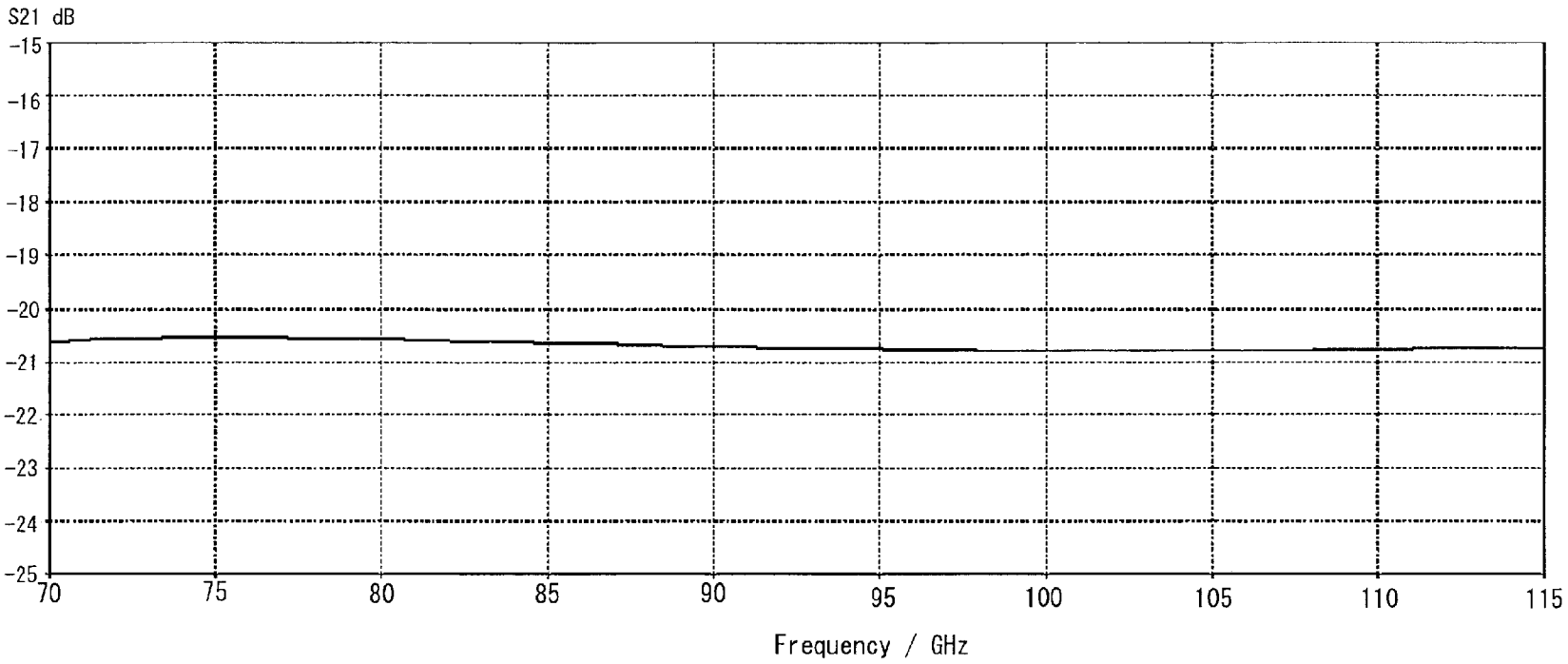
FIG. 9 is a transmission characteristic diagram of an electric wave half mirror having a ridge slit shown in FIGS. 7A to 7C.

With this slit shape, for example, a transmission characteristic of a single mirror when the plate thickness is 0.7 mm, the width and height of the central portion 33*a* of the slit are w3=0.5 mm and h3=40 μm, and the width and height of both side portions 33*b* and 33*c* are w4=1.02 mm and h4=0.2 mm (a transmission characteristic in a state where the electric wave half mirror is provided in the transmission line having the same outside as the plate) is shown in FIG. 9. As shown in FIG. 9, a flat transmission characteristic over a wide range of flat 70 to 115 GHz is shown.

The above-described numerical example is a result obtained by changing the parameters, such as the plate thickness and the width and height of each of the central portion and both side portions of the slit, in various ways. Although the numerical values are not intended to specify the invention, as described above, it has been confirmed that portions having different heights are provided in the slit, and changes in characteristic to changes in increased parameters are recognized to set the parameters, thereby making the transmission characteristic of the electric wave half mirror flat.

Though not described in detail, in regards to the tendency of changes in characteristic to changes in parameters, as the height h3 of the central portion 33*a* of the slit increases, transmittance increases in the entire frequency band, and a noticeable change in transmission characteristic to a change in the height h4 of both side portions 33*b* and 33*c* does not appear. As the width w3 of the central portion 33*a* decreases (that is, the width w4 of both side portions 33*b* and 33*c* increases), transmittance tends to increase in the entire frequency band. If the gradient of the transmission characteristic largely changes to change in plate thickness and the thickness increases in a predetermined range, the gradient of the transmission characteristic changes from negative to positive.

Accordingly, the plate thickness is set to a value such that the gradient of the transmission characteristic becomes substantially 0 (the transmission characteristic is substantially parallel to a frequency axis), and the height h3 and width w3 of the central portion 33*a* of the slit are set to values such that preferable transmittance (for example, about 20 dB) as a half mirror for use in a resonator, whereby it is possible to make the transmission characteristic flat. The above-described numerical example shows an example.

Figure 10:
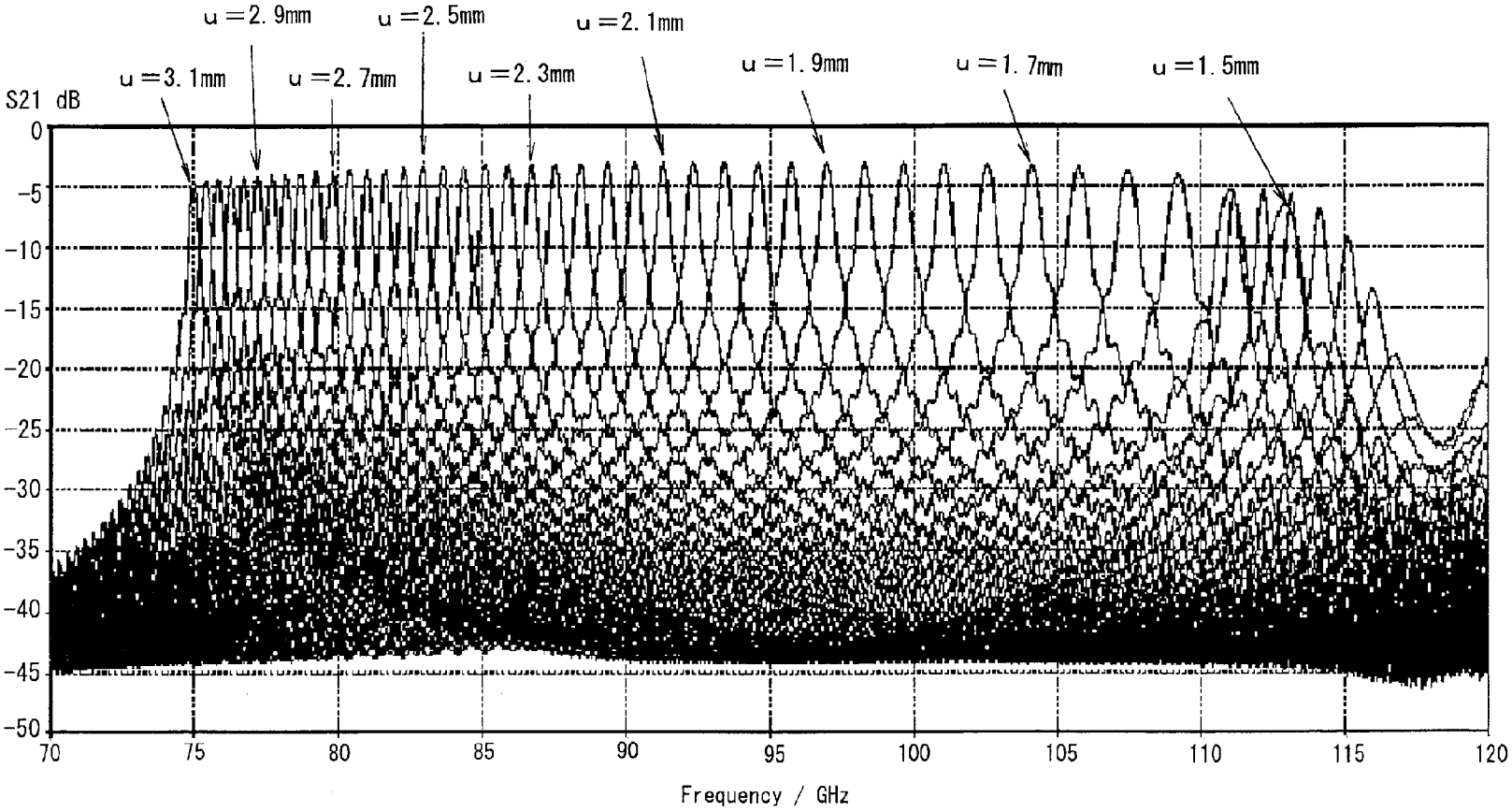
FIG. 10 is a transmission characteristic diagram when a half mirror interval varies in the millimeter waveband filter shown in FIGS. 7A to 7C.

FIG. 10 shows a transmission characteristic when a half mirror interval u is varied from 3.1 mm to 1.5 mm with 0.04 mm step in the millimeter waveband filter 20' shown in FIGS. 7A to 7C.

As will be apparent from the drawing, it is understood that a filter characteristic with substantially constant loss in a predetermined frequency range of 75 to 110 GHz is obtained through the use of a small ridge waveguide as the second waveguide 24.

In FIG. 10, a peak which appears near a characteristic of a half mirror interval u=1.5 mm (equal to or greater than 111 GHz) is sub-resonance when the half mirror interval u is wide (3.1 mm to 2.9 mm). While a drop near 117 GHz is loss due to the occurrence of a different mode (LSE11), it is understood that, when a square waveguide is used as the second waveguide 24, a peak which occurs in a usage band can be moved to a band higher than the usage band.

DESCRIPTION OF REFERENCE NUMERALS AND SIGNS

20, 20': millimeter waveband filter, 22: first waveguide, 23, 23': transmission line (the inside of the first waveguide), 24: second waveguide, 25: transmission line (the inside of the second waveguide), 25*a*: central portion, 25*b*, 25*c*: side portion, 30A, 30B: electric wave half mirror, 31A, 31B: plate, 32A, 32B: slit, 33*a*: central portion, 33*b*: side portion, 40: interval variable means, 60: groove

What is claimed is:

1. A millimeter waveband filter comprising:

a first waveguide;

a second waveguide, the second waveguide being connected to the first waveguide in a state where one end of the second waveguide is inserted into the first waveguide to constitute a transmission line allowing electromagnetic waves in a predetermined frequency range of a millimeter waveband to propagate in a TE10 mode;

a pair of flat electric wave half mirrors which have characteristics to transmit a part of the electromagnetic waves in the predetermined frequency range and to reflect a part of the electromagnetic waves and are arranged to face each other at an interval in a state where the first waveguide and the second waveguide are blocked; and variable interval means for relatively moving the first waveguide and the second waveguide in a longitudinal direction of the transmission line in a state connected together to change the interval between the pair of electric wave half mirrors, wherein frequency components centering on a resonance frequency of a resonator formed between the pair of electric wave half mirrors are selectively transmitted, the first waveguide is a rectangular waveguide in which the sectional shape of the inside of the first waveguide is a rectangular shape such that a lower limit frequency of a propagatable frequency band of the first waveguide in the TE10 mode is equal to or less than a lower limit of the predetermined frequency range, the second waveguide is a ridge waveguide in which the outside thereof is a rectangular shape at a predetermined interval with respect to the inside of the first waveguide and the sectional shape of the inside thereof has a central portion having a height smaller than the height of both side portions, and the height and width of each of both side portions and the central portion are set such that a lower limit frequency of a propagatable frequency band of the second waveguide in the TE10 mode is equal to or less than the lower limit frequency of the propagatable frequency band of the first waveguide.

2. The millimeter waveband filter according to claim 1, wherein a groove which has a length along the longitudinal direction of the transmission line corresponding to a ¼ wavelength of electromagnetic waves to be a leakage prevention target is formed on the outside of the second waveguide facing the inside of the first waveguide, and leakage of the electromagnetic waves from the interval between the outside of the second waveguide and the inside of the first waveguide is prevented by the groove.

3. The millimeter waveband filter according to claim 2, wherein the pair of electric wave half mirrors respectively have rectangular plates which have a predetermined thickness and reflect electromagnetic waves propagating through the transmission line, and have slits which are formed in central portions of the plates along a long side direction of the plates and transmit a part of the electromagnetic waves propagating through the transmission line, the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range, and the predetermined frequency range is 75 to 110 GHz.

4. The millimeter waveband filter according to claim 3, wherein the sectional shape of the inside of the second waveguide is linearly symmetrical with a center line in a height direction and a center line in a width direction of the rectangular shape of the outside of the second waveguide.

5. The millimeter waveband filter according to claim 4, wherein the groove is provided in a plurality of stages with respect to a length direction of the transmission line.

6. The millimeter waveband filter according to claim 5, wherein the groove has a width of about 1 mm and a depth of about 0.2 mm.

7. The millimeter waveband filter according to claim 4, wherein the groove has a width of about 1 mm and a depth of about 0.2 mm.

8. The millimeter waveband filter according to claim 3, wherein the groove is provided in a plurality of stages with respect to a length direction of the transmission line.

9. The millimeter waveband filter according to claim 8, wherein the groove has a width of about 1 mm and a depth of about 0.2 mm.

10. The millimeter waveband filter according to claim 3, wherein the groove has a width of about 1 mm and a depth of about 0.2 mm.

11. The millimeter waveband filter according to claim 2, wherein the sectional shape of the inside of the second waveguide is linearly symmetrical with a center line in a height direction and a center line in a width direction of the rectangular shape of the outside of the second waveguide.

12. The millimeter waveband filter according to claim 11, wherein the groove is provided in a plurality of stages with respect to a length direction of the transmission line.

13. The millimeter waveband filter according to claim 12, wherein the groove has a width of about 1 mm and a depth of about 0.2 mm, and the predetermined frequency range is 75 to 110 GHz.

14. The millimeter waveband filter according to claim 11, wherein the groove has a width of about 1 mm and a depth of about 0.2 mm, and the predetermined frequency range is 75 to 110 GHz.

15. The millimeter waveband filter according to claim 2, wherein the groove is provided in a plurality of stages with respect to a length direction of the transmission line.

16. The millimeter waveband filter according to claim 15, wherein the groove has a width of about 1 mm and a depth of about 0.2 mm, and the predetermined frequency range is 75 to 110 GHz.

17. The millimeter waveband filter according to claim 2, wherein the groove has a width of about 1 mm and a depth of about 0.2 mm, and the predetermined frequency range is 75 to 110 GHz.

18. The millimeter waveband filter according to claim 1, wherein the pair of electric wave half mirrors respectively have rectangular plates which have a predetermined thickness and reflect electromagnetic waves propagating through the transmission line, and have slits which are formed in central portions of the plates along a long side direction of the plates and transmit a part of the electromagnetic waves propagating through the transmission line, the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range, and the predetermined frequency range is 75 to 110 GHz.

19. The millimeter waveband filter according to claim 18, wherein the sectional shape of the inside of the second waveguide is linearly symmetrical with a center line in a height direction and a center line in a width direction of the rectangular shape of the outside of the second waveguide.

20. The millimeter waveband filter according to claim 1, wherein the sectional shape of the inside of the second waveguide is linearly symmetrical with a center line in a height direction and a center line in a width direction of the rectangular shape of the outside of the second waveguide.

* * * * *